US008733225B1

(12) United States Patent
Farinella et al.

(10) Patent No.: US 8,733,225 B1
(45) **Date of Patent: *May 27, 2014**

(54) RPG DEFEAT METHOD AND SYSTEM

(71) Applicant: QinetiQ North America, Inc., McLean, VA (US)

(72) Inventors: Michael D. Farinella, Bolton, MA (US); Robert Lee Cardenas, Framingham, MA (US); William R. Lawson, Hamilton, MA (US); Brendan LaBrecque, Peabody, MA (US); Frances Rush, Norwood, MA (US); David Hoadley, Lexington, MA (US); Michael Wheaton, Newton, MA (US); Mike Anderson, Lowell, MA (US); Thomas Mann, Littleton, MA (US); Abed Kanaan, Still River, MA (US); Patrick Callahan, Maynard, MA (US)

(73) Assignee: QinteiQ Nörth America, Inc., McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/624,287

(22) Filed: Sep. 21, 2012

Related U.S. Application Data

(63) Continuation of application No. 12/807,532, filed on Sep. 8, 2010, now abandoned, which is a continuation-in-part of application No. 12/386,114, filed on Apr. 14, 2009, now Pat. No. 8,011,285.

(60) Provisional application No. 61/124,428, filed on Apr. 16, 2008.

(51) Int. Cl.
*F41H 13/00* (2006.01)

(52) U.S. Cl.
USPC ..... 89/36.08; 89/918; 89/939

(58) Field of Classification Search
USPC ..... 89/36.01–36.17; 109/49.5; 114/241; 296/187.07
See application file for complete search history.

(56) References Cited

U.S. PATENT DOCUMENTS

| | | | |
|---|---|---|---|
| 1,198,035 | A | 9/1916 | Huntington |
| 1,204,547 | A | 11/1916 | Corrado et al. |
| 1,229,421 | A | 6/1917 | Downs |
| 1,235,076 | A | 7/1917 | Stanton |
| 1,274,624 | A | 8/1918 | Steinmetz |

(Continued)

FOREIGN PATENT DOCUMENTS

| | | |
|---|---|---|
| DE | 691067 | 5/1940 |
| DE | 2206404 | 8/1973 |

(Continued)

OTHER PUBLICATIONS

Written Opinion of the International Searching Authority mailed Jan. 7, 2010 for International Application No. PCT/US2009/002363, 5 pages, unnumbered.

(Continued)

*Primary Examiner* — Bret Hayes
*Assistant Examiner* — Joshua Freeman
(74) *Attorney, Agent, or Firm* — Iandiorio Teska & Coleman, LLP

(57) ABSTRACT

A vehicle and structure shield includes an array of hard points laterally spaced and outwardly supported, in one example, by a net subsystem and frame.

20 Claims, 12 Drawing Sheets

(56) References Cited

U.S. PATENT DOCUMENTS

| | | | | |
|---|---|---|---|---|
| 1,367,249 | A | | 2/1921 | Goodyear |
| 1,385,897 | A | | 7/1921 | Tresidder |
| 1,552,269 | A | | 9/1925 | Brocker |
| 2,238,779 | A | | 4/1941 | Mosebach |
| 2,296,980 | A | | 9/1942 | Carmichael |
| 2,308,683 | A | | 1/1943 | Forbes |
| 2,322,624 | A | | 6/1943 | Forbes |
| 3,608,034 | A | | 9/1971 | Bramley et al. |
| 3,633,936 | A | | 1/1972 | Huber |
| 3,656,790 | A | | 4/1972 | Truesdell |
| 3,656,791 | A | | 4/1972 | Truesdell |
| 3,733,243 | A | | 5/1973 | Crawford |
| 3,893,368 | A | | 7/1975 | Wales, Jr. |
| 3,950,584 | A | | 4/1976 | Bramley |
| 3,992,628 | A | | 11/1976 | Karney |
| 4,051,763 | A | | 10/1977 | Thomanek |
| 4,157,411 | A | | 6/1979 | Thomson |
| 4,253,132 | A | | 2/1981 | Cover |
| 4,262,595 | A | | 4/1981 | Longerich |
| 4,358,984 | A | | 11/1982 | Winblad |
| 4,399,430 | A | | 8/1983 | Kitchen |
| 4,411,462 | A | | 10/1983 | Buehrig et al. |
| 4,688,024 | A | | 8/1987 | Gadde |
| 4,768,417 | A | | 9/1988 | Wright |
| 4,912,869 | A | | 4/1990 | Govett |
| 4,928,575 | A | | 5/1990 | Smirlock et al. |
| 4,950,198 | A | | 8/1990 | Repko, Jr. |
| 5,007,326 | A | | 4/1991 | Gooch, Jr. et al. |
| 5,025,707 | A | | 6/1991 | Gonzalez |
| 5,069,109 | A | | 12/1991 | Lavan, Jr. |
| 5,078,117 | A | | 1/1992 | Cover |
| 5,094,170 | A | | 3/1992 | Raynaud et al. |
| 5,170,690 | A | | 12/1992 | Smirlock et al. |
| 5,191,166 | A | | 3/1993 | Smirlock et al. |
| 5,279,199 | A | | 1/1994 | August |
| 5,291,715 | A | | 3/1994 | Basile |
| 5,333,532 | A | | 8/1994 | Smirlock et al. |
| 5,342,021 | A | | 8/1994 | Watson |
| 5,370,035 | A | | 12/1994 | Madden, Jr. |
| 5,394,786 | A | | 3/1995 | Gettle et al. |
| 5,400,688 | A | | 3/1995 | Eninger et al. |
| 5,435,226 | A | | 7/1995 | McQuilkin |
| 5,441,239 | A | * | 8/1995 | Watson ..... 256/1 |
| 5,524,524 | A | | 6/1996 | Richards et al. |
| 5,578,784 | A | | 11/1996 | Karr et al. |
| 5,583,311 | A | | 12/1996 | Rieger |
| 5,609,528 | A | * | 3/1997 | Kehoe ..... 473/157 |
| 5,622,455 | A | | 4/1997 | Anderson et al. |
| 5,646,613 | A | | 7/1997 | Cho |
| 5,705,058 | A | | 1/1998 | Fischer |
| 5,725,265 | A | | 3/1998 | Baber |
| 5,739,458 | A | | 4/1998 | Girard |
| 5,750,918 | A | | 5/1998 | Mangolds et al. |
| 5,792,976 | A | | 8/1998 | Genovese |
| 5,842,939 | A | | 12/1998 | Pui et al. |
| 5,898,125 | A | | 4/1999 | Mangolds et al. |
| 5,924,723 | A | | 7/1999 | Brantman et al. |
| 5,988,036 | A | | 11/1999 | Mangolds et al. |
| 6,029,558 | A | | 2/2000 | Stevens et al. |
| 6,119,574 | A | | 9/2000 | Burkey et al. |
| 6,128,999 | A | | 10/2000 | Sepp et al. |
| 6,279,449 | B1 | | 8/2001 | Ladika et al. |
| 6,282,860 | B1 | | 9/2001 | Ramirez |
| 6,311,605 | B1 | | 11/2001 | Kellner et al. |
| 6,325,015 | B1 | | 12/2001 | Garcia et al. |
| 6,374,565 | B1 | | 4/2002 | Warren |
| 6,375,251 | B1 | | 4/2002 | Taghaddos |
| 6,394,016 | B2 | | 5/2002 | Swartout et al. |
| 6,499,796 | B1 | | 12/2002 | Eenhoorn |
| 6,595,102 | B2 | | 7/2003 | Stevens et al. |
| 6,626,077 | B1 | | 9/2003 | Gilbert |
| 6,672,220 | B2 | | 1/2004 | Brooks et al. |
| 6,782,792 | B1 | | 8/2004 | Edberg et al. |
| 6,805,035 | B2 | | 10/2004 | Edberg et al. |
| 6,854,374 | B1 | | 2/2005 | Breazeale |
| 6,901,839 | B2 | | 6/2005 | Edberg et al. |
| 6,904,838 | B1 | | 6/2005 | Dindl |
| 6,925,771 | B2 | | 8/2005 | Lee et al. |
| 6,957,602 | B1 | | 10/2005 | Koenig et al. |
| 7,177,518 | B2 | | 2/2007 | Chun |
| 7,190,304 | B1 | | 3/2007 | Carlson |
| 7,244,199 | B1 | | 7/2007 | Romano |
| 7,308,738 | B2 | | 12/2007 | Barvosa-Carter et al. |
| 7,318,258 | B2 | | 1/2008 | Chun |
| 7,328,644 | B2 | | 2/2008 | Vickroy |
| 7,412,916 | B2 | | 8/2008 | Lloyd |
| 7,415,917 | B2 | | 8/2008 | Lloyd |
| 7,513,186 | B2 | | 4/2009 | Ravid et al. |
| 7,866,248 | B2 | | 1/2011 | Moore et al. |
| 7,866,250 | B2 | | 1/2011 | Farinella et al. |
| 8,011,285 | B2 | | 9/2011 | Farinella et al. |
| 8,132,495 | B2 | | 3/2012 | Joynt |
| 2001/0032577 | A1 | | 10/2001 | Swartout et al. |
| 2001/0048102 | A1 | | 12/2001 | Tellis |
| 2002/0134365 | A1 | | 9/2002 | Gray |
| 2003/0217502 | A1 | | 11/2003 | Hansen |
| 2004/0016846 | A1 | | 1/2004 | Blackwell-Thompson et al. |
| 2005/0011396 | A1 | | 1/2005 | Burdette et al. |
| 2005/0016372 | A1 | | 1/2005 | Kilvert |
| 2005/0278098 | A1 | | 12/2005 | Breed |
| 2006/0065111 | A1 | | 3/2006 | Henry |
| 2006/0112817 | A1 | | 6/2006 | Lloyd |
| 2007/0057495 | A1 | | 3/2007 | Tesch et al. |
| 2007/0089597 | A1 | | 4/2007 | Ma |
| 2007/0180983 | A1 | * | 8/2007 | Farinella et al. ..... 89/36.07 |
| 2008/0164379 | A1 | | 7/2008 | Wartmann et al. |
| 2008/0258063 | A1 | | 10/2008 | Rapanotti |
| 2009/0084284 | A1 | | 4/2009 | Martinez et al. |
| 2009/0104422 | A1 | | 4/2009 | Sampson |
| 2009/0173250 | A1 | | 7/2009 | Marscher et al. |
| 2009/0178597 | A1 | | 7/2009 | Sliwa, Jr. |
| 2009/0217811 | A1 | | 9/2009 | Leeming |
| 2009/0266226 | A1 | | 10/2009 | Beach et al. |
| 2009/0308238 | A1 | | 12/2009 | Schwartz |
| 2010/0282935 | A1 | | 11/2010 | Zannoni |
| 2010/0288114 | A1 | * | 11/2010 | Soukos ..... 89/36.02 |
| 2010/0294124 | A1 | | 11/2010 | Wentzel |
| 2010/0307328 | A1 | | 12/2010 | Hoadley et al. |
| 2011/0067561 | A1 | | 3/2011 | Joynt |
| 2011/0079135 | A1 | | 4/2011 | Farinella et al. |
| 2011/0136087 | A1 | | 6/2011 | Corridon |
| 2011/0179944 | A1 | | 7/2011 | Farinella et al. |
| 2011/0185614 | A1 | | 8/2011 | Laney et al. |
| 2011/0192014 | A1 | | 8/2011 | Holmes, Jr. et al. |
| 2011/0203453 | A1 | | 8/2011 | Farinella et al. |
| 2011/0252955 | A1 | | 10/2011 | Radstake et al. |
| 2012/0011993 | A1 | | 1/2012 | Malone et al. |
| 2012/0046916 | A1 | | 2/2012 | Farinella et al. |
| 2012/0067199 | A1 | | 3/2012 | Farinella et al. |
| 2012/0180639 | A1 | | 7/2012 | Farinella et al. |

FOREIGN PATENT DOCUMENTS

| | | | |
|---|---|---|---|
| DE | 2409876 | | 9/1975 |
| DE | 25 07 351 | | 9/1976 |
| DE | 3722420 | | 1/1989 |
| DE | 3735426 | | 5/1989 |
| DE | 3834367 | | 4/1990 |
| DE | 4437412 | | 9/1995 |
| EP | 0655603 | | 5/1995 |
| EP | 0872705 | | 10/1998 |
| EP | 0902250 | | 3/1999 |
| FR | 2695467 | | 3/1994 |
| GB | 2449055 | | 11/2008 |
| WO | WO 99/30966 | | 6/1999 |
| WO | WO 2006/134407 | | 12/2006 |
| WO | WO 2006/135432 | | 12/2006 |
| WO | WO2006135432 | * | 12/2006 ..... B64F 1/02 |
| WO | WO 2008/079001 | | 7/2008 |
| WO | WO 2008/070001 | | 12/2008 |

OTHER PUBLICATIONS

Written Opinion mailed Nov. 13, 2012 for International Application No. PCT/US2011/01459, 5 pages, unnumbered.

(56) References Cited

OTHER PUBLICATIONS

Written Opinion of the International Searching Authority mailed, dated Dec. 23, 2011 for International Application No. PCT/US2011/01462, 6 pages, unnumbered.

File History of U.S. Patent Publication No. 2008/0164379 (through Mar. 1, 2011), 304 pages, unnumbered.

Written Opinion of the International Searching Authority mailed Jan. 31, 2013 for International Application No. PCT/US2012/063207 (six (6) pages total).

* cited by examiner

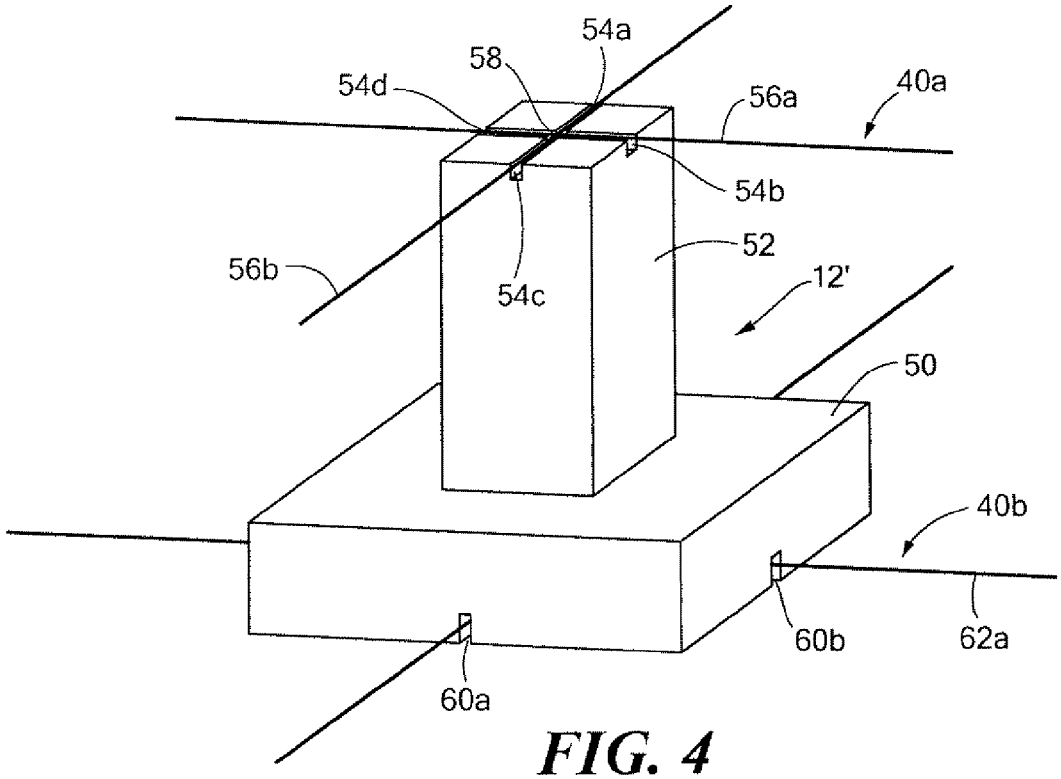
FIG. 4
FIG. 5
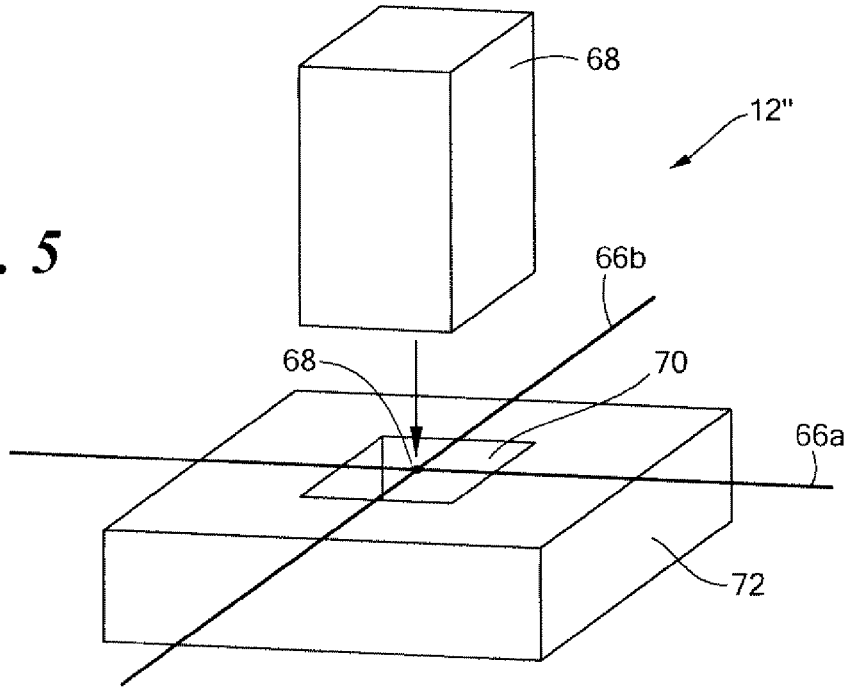

RPG DEFEAT METHOD AND SYSTEM

RELATED APPLICATIONS

This application is a continuation of U.S. patent application Ser. No. 12/807,532 filed Sep. 8, 2010 which is a continuation-in-part of U.S. patent application Ser. No. 12/386,114 filed on Apr. 14, 2009 which claims the benefit of and priority to Provisional Application No. 61/124,428 filed on Apr. 16, 2008 under 35 U.S.C. §§119, 120, 363, 365, and 37 C.F.R. §1.55 and §1.78, all incorporated herein by this reference.

FIELD OF THE INVENTION

The subject invention relates to ordinance shielding.

BACKGROUND OF THE INVENTION

Rocket propelled grenades (RPGs) and other ordinance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6,957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain like fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pickup trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s, RPG-69s, and RPG-7Ls have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Chain link fencing has been used in an attempt to dud RPGs by destroying the RPG nose cone. See, for example, DE 691,067. See also published U.S. Patent Application No. 2008/0164379. Others have proposed using netting to strangulate the RPG nose cone. See published U.S. Application No. 2009/0217811 and WO 20061135432.

WO 2006/134407, insofar as it can be understood, discloses a protective grid with tooth shaped members. U.S. Pat. No. 6,311,605 discloses disruptive bodies secured to armor. The disruptive bodies are designed to penetrate into an interior region of a shaped charge to disrupt the formation of the jet. The shaped charge disclosed has a fuse/detonator mechanism in its tail end.

BRIEF SUMMARY OF THE INVENTION

No known prior art, however, discloses a net supporting a spaced array of hard points at a set off distance from a vehicle or a structure wherein the hard points are designed to dig into the nose cone of an RPG and dud it.

Pending U.S. patent application Ser. No. 11/351,130 filed Feb. 8, 2006, incorporated herein by this reference, discloses a novel vehicle protection system. The following reflects an enhancement to such a system.

In accordance with one aspect of the subject invention, a new vehicle and structure shield is provided which, in one specific version, is inexpensive, lightweight, easy to install and remove (even in the field), easy to adapt to a variety of platforms, effective, and exhibits a low vehicle signature. Various other embodiments are within the scope of the subject invention.

The subject invention results from the realization, in part, that a new vehicle and structure shield, in one specific example, features a plurality of spaced rods or hard points held in position via the nodes of a net and used to dud an RPG or other threat allowing the frame for the net to be lightweight and inexpensive and also easily attached to and removed from a vehicle or structure.

The subject invention features a vehicle and structure shield comprising a flexible net subsystem including an array of rods or hard points supported by the net subsystem and configured to impact a projectile striking the net. A frame including mounting brackets attached thereto positions the frame in a spaced relationship with respect to the vehicle or structure. A first releasable fastener subsystem releasably secures the net subsystem to the frame. A second releasable fastener subsystem releasably secures the mounting brackets of the frame to a vehicle or structure.

A vehicle and structure shield system in accordance with the invention features a flexible structure with a fabric border including one of a hook and loop type fastener thereon, a frame for the flexible structure including frame members with the other of hook and loop fastener thereon for releasably securing the flexible structure to the frame, and hard points attached to the flexible structure.

The frame members typically include the other of the hook and loop fastener material thereon in a spiral wrap configuration thereabout. One preferred flexible structure includes a net with nodes and hard points are attached to the nets at the nodes in an array. The frame may further include rearwardly extending members. In one design, the frame includes frame members forming a polygon with spaced sides and an upper and a lower portion. There may be two spaced rearwardly extending members attached to the upper portion and rearwardly extending members on each side extending from the lower portion to the upper portion with a hinged joint therebetween.

The preferred hard points each include a post portion and a base portion with a cavity receiving the post portion therein. In one specific design, each hard point includes a front face, sidewalls extending rearward from the front face including slots therethrough for the cords of a net, a cavity surrounded by the sidewalls, and a plug sized to be frictionally received in the cavity locking the cords of the net in the cavity.

The plug may include an outer wall with a knurled surface. The front face may have six sides then there are six two opposing sidewalls which may have slots therethrough in the middle of the opposing sidewalls and there may be a slot between adjacent sidewalls on each side of the two opposing sidewalls.

In one embodiment, the hard points include steel, weigh between 10 and 80 grams, the front face has an area of between 0.1 and 0.8 in.$^2$, the sidewalls each have an area of between 0.1 and 0.8 in.$^2$, the cavity is round, and the plug is cylindrical in shape. Typically, the slots each terminate in a rounded portion.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which:

FIG. 4 is a schematic three-dimensional front view showing one example of a hard point rod attached to adjacent nodes of two spaced nets in accordance with the subject invention;

FIG. 5 is a schematic three-dimensional exploded view showing another example of a hard point rod in accordance with the subject invention;

DETAILED DESCRIPTION OF THE INVENTION

Figure 1:
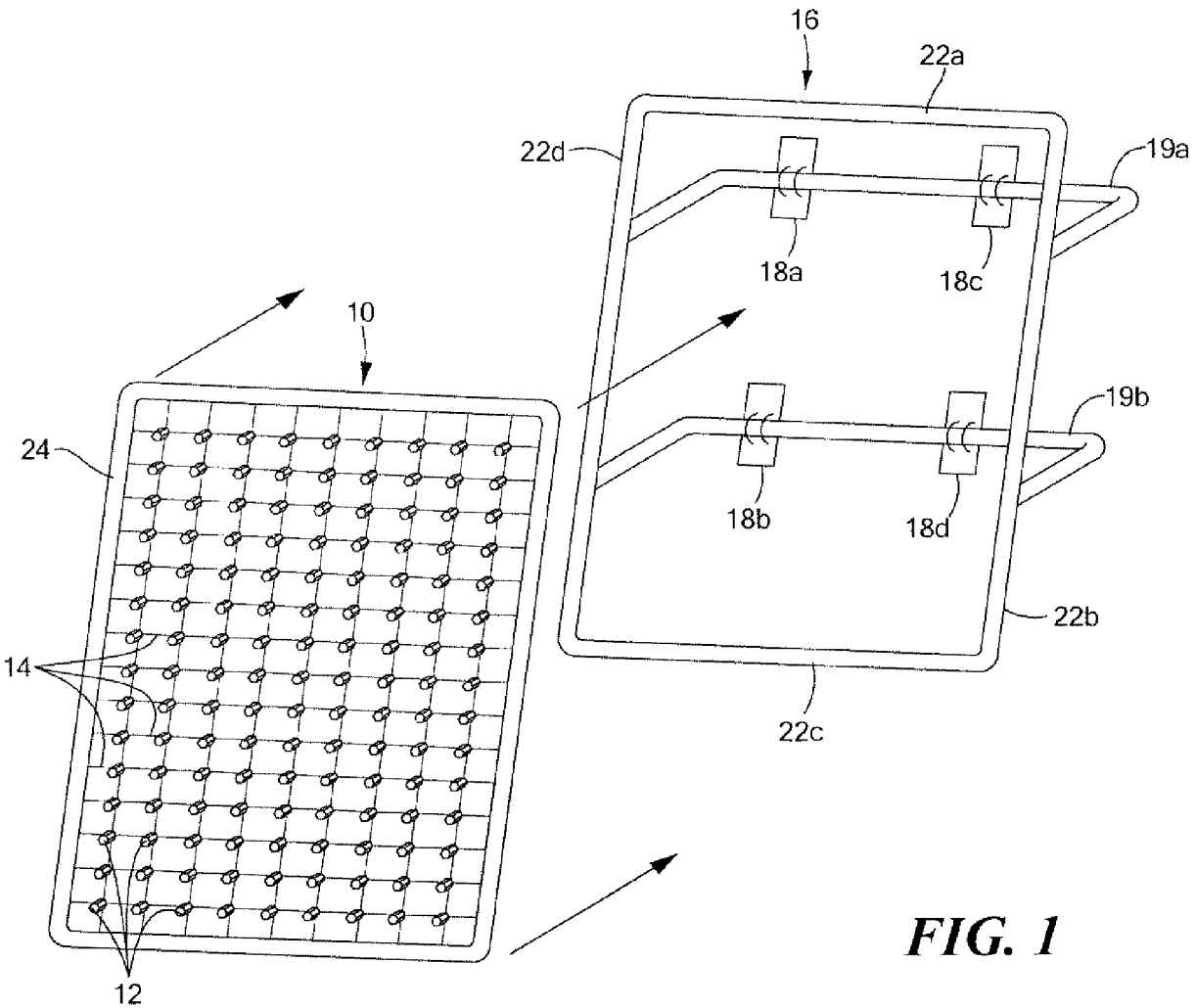
FIG. 1 is a highly schematic three-dimensional exploded view showing an example of one shield protection system in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of flexible structures, e.g., net subsystem 10 and including an array of rods 12 configured to impact a projectile (e.g., the nose of an RPG) striking net 14. Frame 16 includes mounting brackets 18*a*-18*d* attached to rearwardly extending members 19*a* and 19*b*. The function of frame 16 and net 14 is to position rods 12 in a spaced relationship with respect to a vehicle or structure and to space the rods 12 apart from each other in an array. When an RPG impacts net 14, rods 12 may angle inwardly towards the nose of the RPG tearing into it and duding the electronics and/or electrical or electronic signals associated with the arming or detonation mechanisms of the RPG. By flexible, we generally mean a net which does not retain its shape unless supported in some fashion. When not attached to frame 16, net 14 can be rolled and then folded and/or net 14 can be bunched up.

Figure 2:
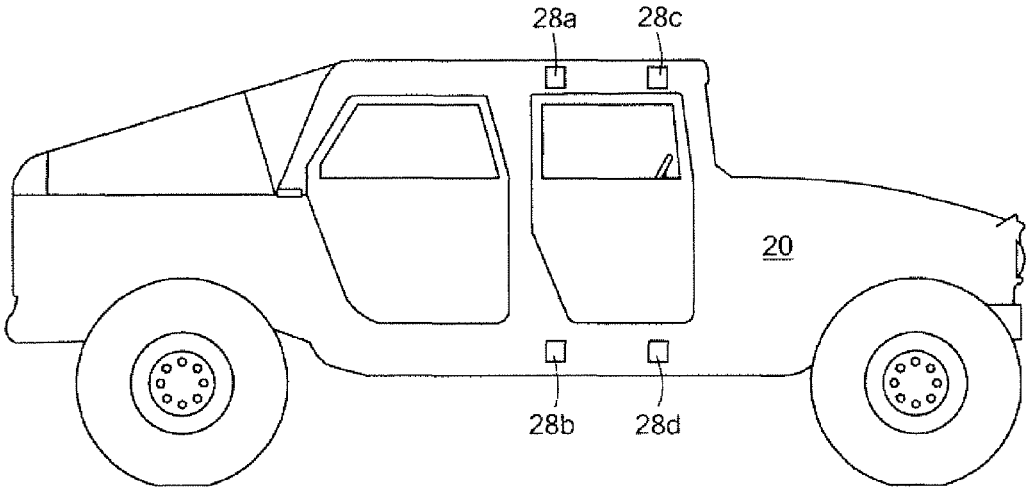
FIG. 2 is a schematic side view of a HMMWV vehicle equipped with hook and loop patches for installation of the shield system shown in FIG. 1.

Preferably, net subsystem 10 is removeably secured to frame 16 and frame 16 is removeably secured to vehicle 20, FIG. 2 (e.g., a HMMWV vehicle). In one particular example, frame members 22*a*-22*d* include hook type fasteners secured to the outside thereof and the net periphery includes loop type fasteners on the inside thereof. Loop type fasteners are also secured to the rear of frame 16 mounting brackets 18*a*-18*d* and corresponding pads or patches 28*a*-28*d*, FIG. 2, adhered to vehicle 20, include outer faces with hook type fasteners. The hook and loop fastening mechanisms, however, maybe reversed and other flexible fastener subsystems may also be used. The hook and loop fastening subsystems of U.S. Pat. Nos. 4,928,575; 5,170,690; 5,191,166; and 5,333,532 are preferred.

Figure 3:
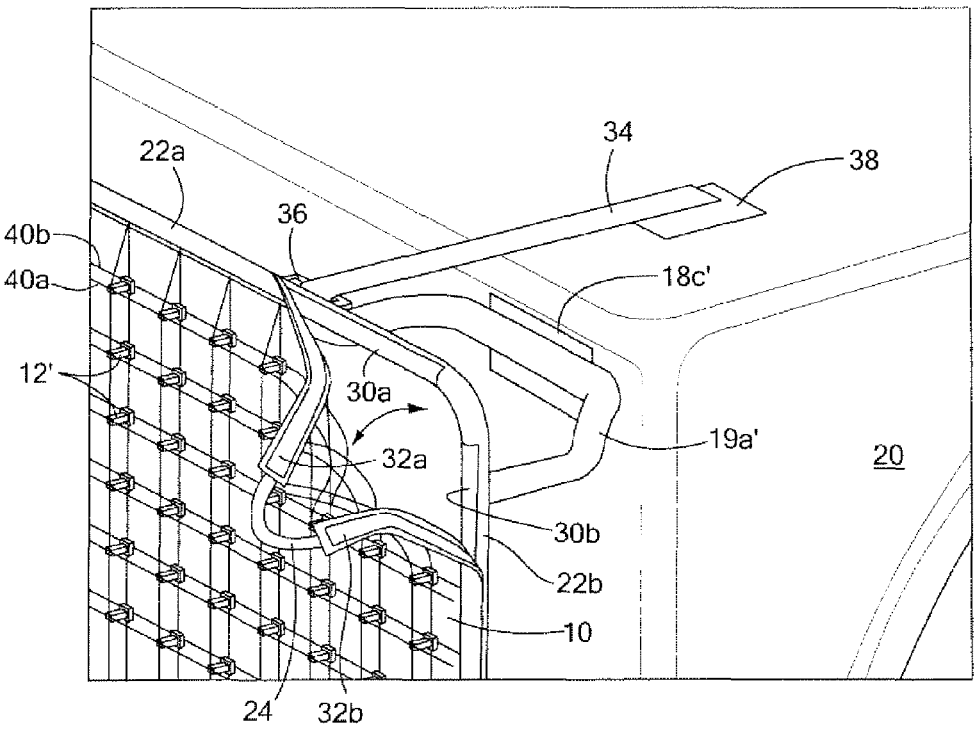
FIG. 3 is a schematic partial side view showing a shield subsystem in accordance with an example of the subject invention now installed on a portion of a vehicle.

FIG. 3 shows frame members 22*a* and 22*b* including hook type fastener strips 30*a* and 30*b*, respectively, and net periphery fabric border 24 including loop type fastener strips 32*a* and 32*b*. Mounting bracket 18*c*' is attached to rearwardly extending frame member 19*a*' and includes a rearward face with loop type fasteners. FIG. 3 also shows optional strap 34 extending from ear 36 on frame member 22*a* to attachment 38 on vehicle 20 which may also be secured to vehicle 20 using hook and loop fasteners. Additional straps may also be included. FIG. 3 also shows first (outer) net 40*a* and second (inner) net 40*b* with their nodes interconnected via rods 12'.

As shown in FIG. 4, rod 12' includes base portion 50 and post portion 52 extending from base portion 50. Post 52 includes castellations 54*a*-54*d* for the chord lines 56*a* and 56*b* of net 40*a* defining node 58. Similarly, base 50 includes castellations (e.g. castellations 60*a* and 60*b*) for lines 62*a* and 62*b* of net 40*b* also defining a node (not shown). The lines of the nets may be glued or otherwise secured in the castellations.

FIG. 5 shows a single net design where net lines 66*a* and 66*b* defining node 68 are secured between post portions 68 frictionally received in cavity 70 of base portion 72 of rod 12". The preferred rod is made of steel, has a one inch post, and weighs between 15 and 30 grams.

Figure 6A:
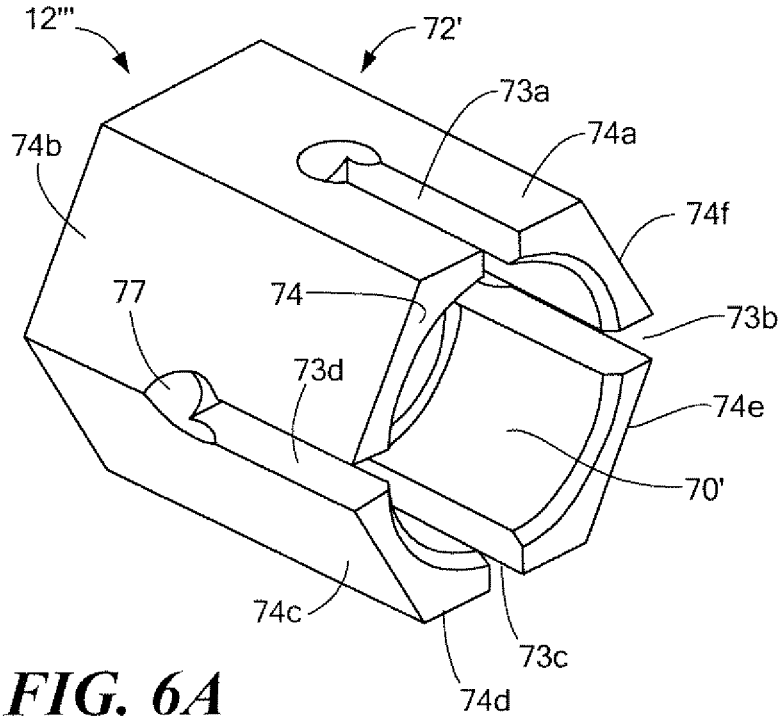
FIGS. 6A-6D are schematic views of other hard point designs in accordance with examples of the subject invention.
Figure 6B:
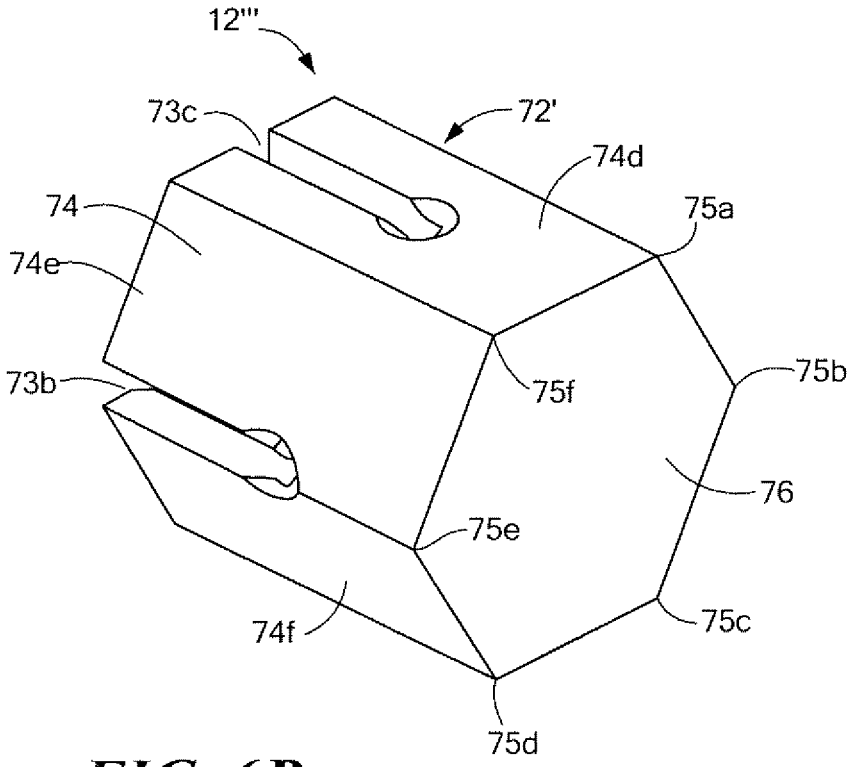
Figure 7A:
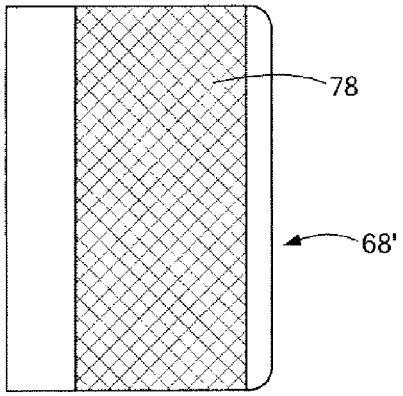
FIG. 7A-7B are schematic views of a plug for the hard point shown in FIGS. 6A-6D.
Figure 7B:
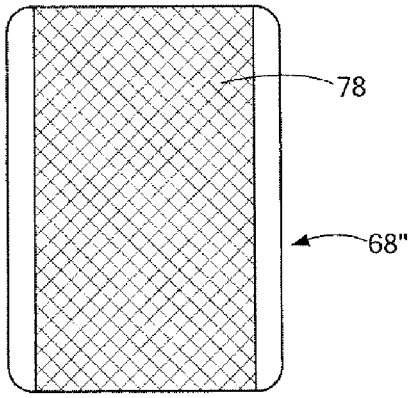

FIGS. 6A-6B shows hard point 12'" with forward facing base portion 72' with cavity 70' receiving post or plug 68', FIG. 7 therein in a friction fit manner. This hard point is designed for nets including horizontal cords intersecting vertical cords. See FIGS. 1 and 5. In this preferred design, the net cords are received through slots 73*a*-*d* in wall 74 of hard point 72'. The slots, as shown for slot 73*a*, terminate in rounded portion 77 preventing wear of the net chords. Wall 74 in this embodiment defines a six-sided structure with six sharp corners 75*a*-75*f* which dig into the skin of an RPG ogive. Top surface 76 may be flat as shown or concave. Slots 73*a* and 73*c* receive vertically extending cord 66*b*, FIG. 5 while slots 73*d* and 73*b*, FIG. 6A receive horizontally extending cord 66*a*, FIG. 5. In one specific design, the hard point and the plug were made of steel, hard point 72' was 0.625 inches from one edge to an opposite edge, and 0.72 inches tall. Cavity 70' was 0.499 inches in diameter and 0.34 inches deep. Five gram cylindrical plug 68', FIGS. 7A-7B was 0.35 inches tall, 0.500 inches in diameter, and includes knurling as shown at 78 on the outer wall surface thereof.

Side walls 74*a*-74*f* extend rearward from front face 76 defining cavity 70' surrounded by the side walls. Opposing sidewalls 74*a* and 74*d* have slots (73*a*, 73*c*) in the middle of each side wall. Slots 73*d*, and 73*b*, in turn, are between adjacent sidewalls 74*b* and 74*c* and 74*f* and 74*e*, respectively. Sidewall 74*b* and 74*c* are between opposing sidewalls 74*a* and 74*b* on one side of member 72' while sidewall 74*f* and 74*e* are between opposing sidewalls 74*a* and 74*d* on the opposite side of member 72'.

In this specific design, the base portion 72' and plug 68' (FIG. 7) were made of hardened steel (e.g., ASTM A108 alloy 12L14) and combined weighed between 10 and 80 grams. A base portion with more or less sides is also possible. For a six sided design, the area of face 76, FIG. 6B, is typically about 0.5 in.$^2$, e.g. between 0.1 and 0.8 in.$^2$. Sidewalls 74*a*-*f* typically have an area of 0.37 in.$^2$, e.g., between 0.1 and 0.8 in.$^2$. Slots 73*a*-*d* may be 0.05-0.15 inches wide and between 0.2 and 0.8 inches long.

Figure 6C:
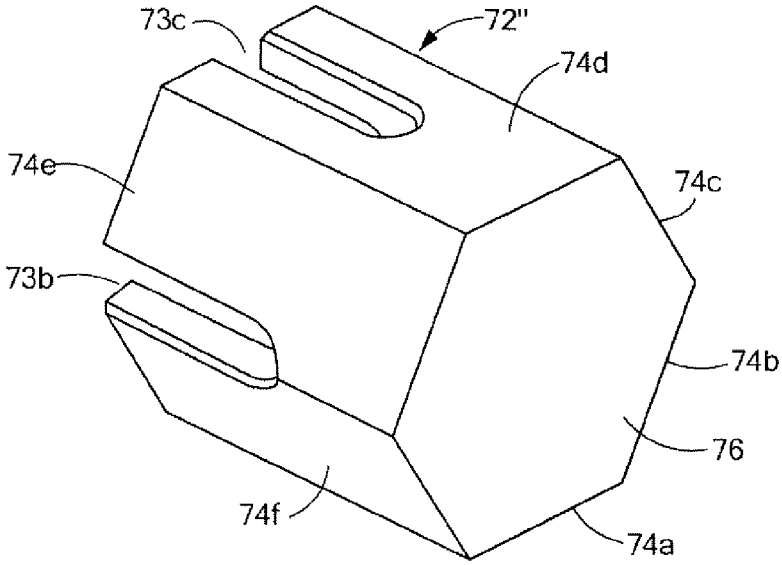
Figure 6D:
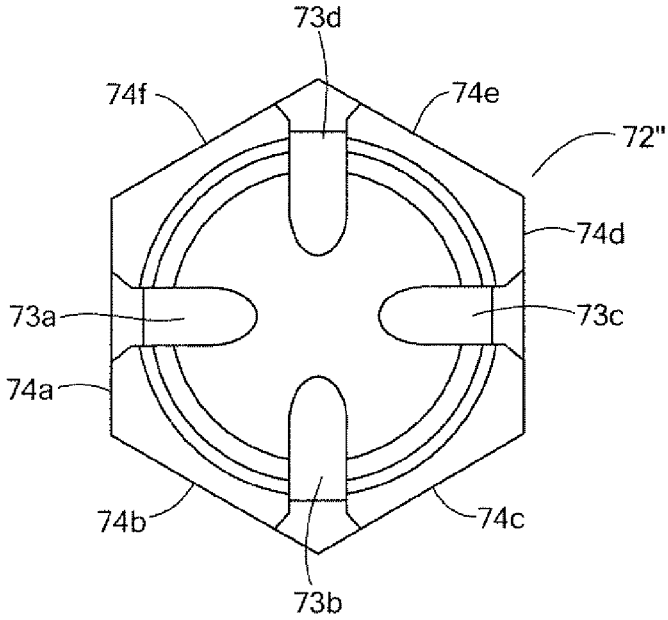

Manufacturing of a net with hard points in accordance with the subject invention is thus simplified. A net node is placed in cavity 70', FIG. 6A with the net chords exciting through slots 73*a*-73*d* and plug 68', FIG. 7A is then driven in to cavity 70', FIG. 6A to lock the node of the net in the hard point. The hard points are typically made of conductive material and may include a protective rust resistant non-reflective, conductive coating (zinc plating, flat olive in color). In one example shown in FIGS. 6C-6D, base portion 72" weighed 30 grams and was machined from 0.625 hex bar stock. Walls 74*a*-74*f* were 0.72" tall. Slots 73*a*-73*d* were 0.080 inches across and 0.350" in length. These dimensions will vary, however, depending on the design of the net.

There are trade offs in the design of the hard points and also the net. The aspect ratio of the hard points, their size, center of gravity, mass, and the like all play an important role. Hard points which are too large, for example, and a net mesh size which is too small, results in too much surface area to be stricken by an RPG, possibly detonating the RPG. Hard points which are too small may not sufficiently damage the RPG ogive and dud the RPG. Steel is a good material choice for the hard points because steel is less expensive. Tungsten, on the other hand, may be used because it is heavier and denser, but tungsten is more expensive. Other materials are possible. The hard points may be 0.5 inch to 0.75 inches across and between 0.5 inches and 1 inch tall.

It is preferred that the net node is placed at the center of gravity at the hard point. The length of the hard point is preferably chosen so that when an RPG strikes the net, the hard point tumbles 90 degrees and digs into the RPG ogive. The moment of inertia of the hard point is designed accordingly. In still other designs, the hard point may have more or less than six sides. The hard points may weigh between 10 to 80 grams although in testing 60 grams was found to be optimal, e.g., a 30 gram base portion and a 30 gram plug. Hard points between 10 and 40 grams are typical.

The net material may be polyester which provides resistance to stretching, ultraviolet radiation resistance, and durability in the field. Kevlar or other engineered materials can be used. A knotted, knotless, braided, or ultracross net may be used. The chord diameter may be 1.7 to 1.9 mm. Larger net cords or multiple cords are possible, however, the cord(s) design should be constrained to beneath threshold force to dynamic break loads typical of RPG impact and engagements. The typical net mesh size may be 176 mm (e.g., a square opening 88 mm by 88 mm) for a PG-7V RPG and 122 mm for a PG-7 VM model RPG. But, depending on the design, the net mesh size may range from between 110 and 190 mm.

The preferred spacing or standoff from the net to the vehicle is between 4 and 24 inches, (e.g., 6-12 inches) but may be between 4 and 60 centimeters. Larger standoffs may extend the footprint of the vehicle and thus be undesirable. Too close a spacing may not insure closing of the electrical circuitry of the RPG ogive by the hard points. The frame and mounting brackets are designed to result in the desired spacing.

It is desirable that the net material and mesh size be chosen and the net designed such that an RPG ogive, upon striking a net chord, does not detonate. RPGs are designed to detonate at a certain impact force. Preferably, the breaking strength of the net chord material is around 240 lbs so that an RPG, upon striking a net chord or chords, does not detonate. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The overall result of the subject invention is a design with more available surface area where duding occurs as opposed to detonation.

Figure 8:
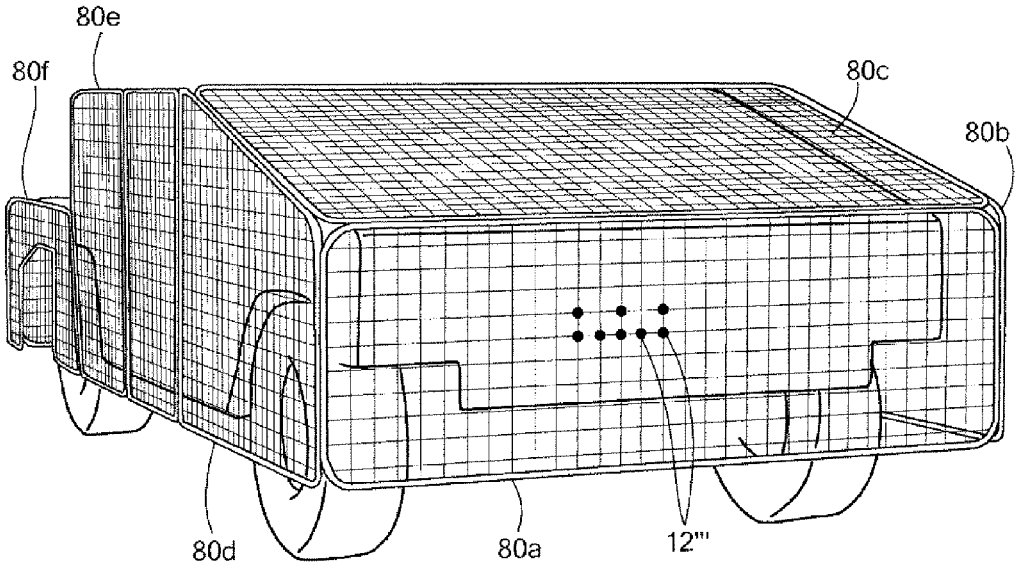
FIG. 8 is a schematic three-dimensional front view showing a number of net shields removeably attached to a military vehicle in accordance with the subject invention.
Figure 9:
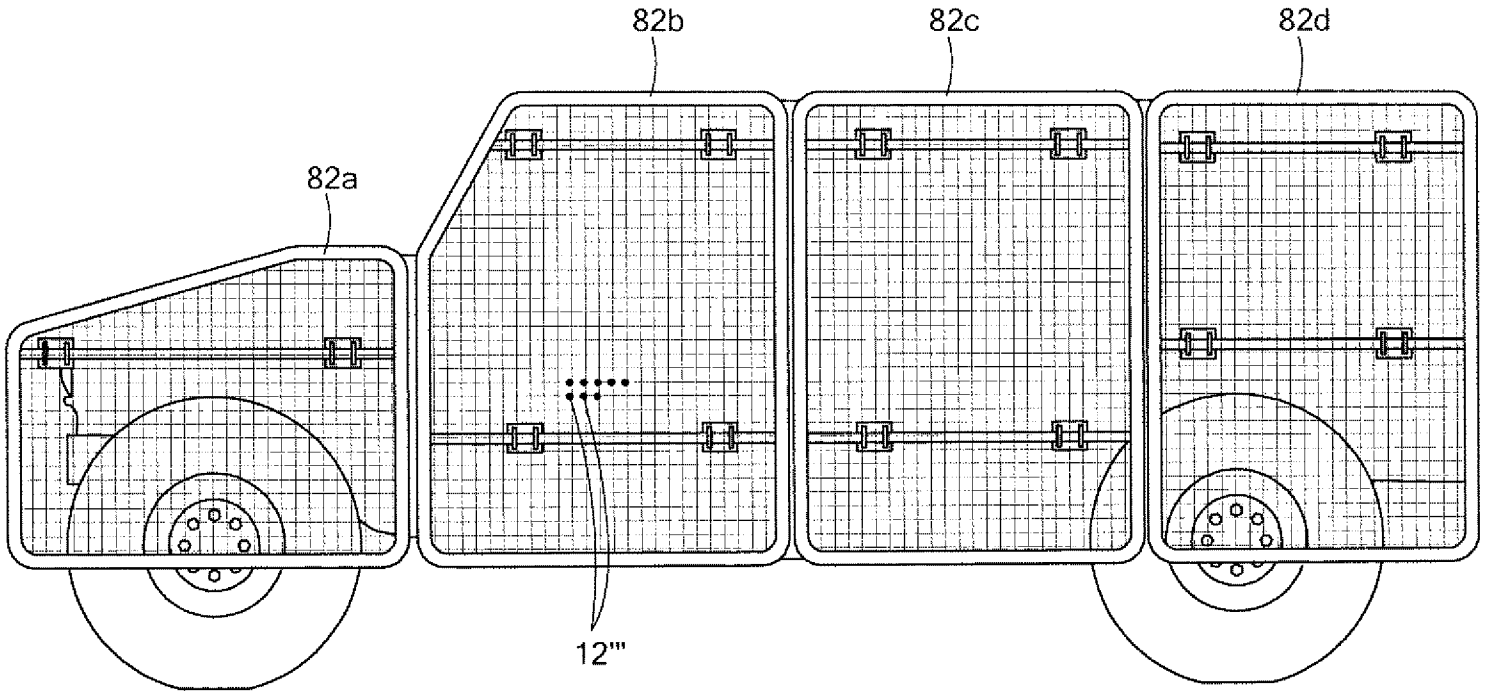
FIG. 9 is a schematic three-dimensional side view showing a number of net shields attached to the side of a military vehicle.
Figure 11:
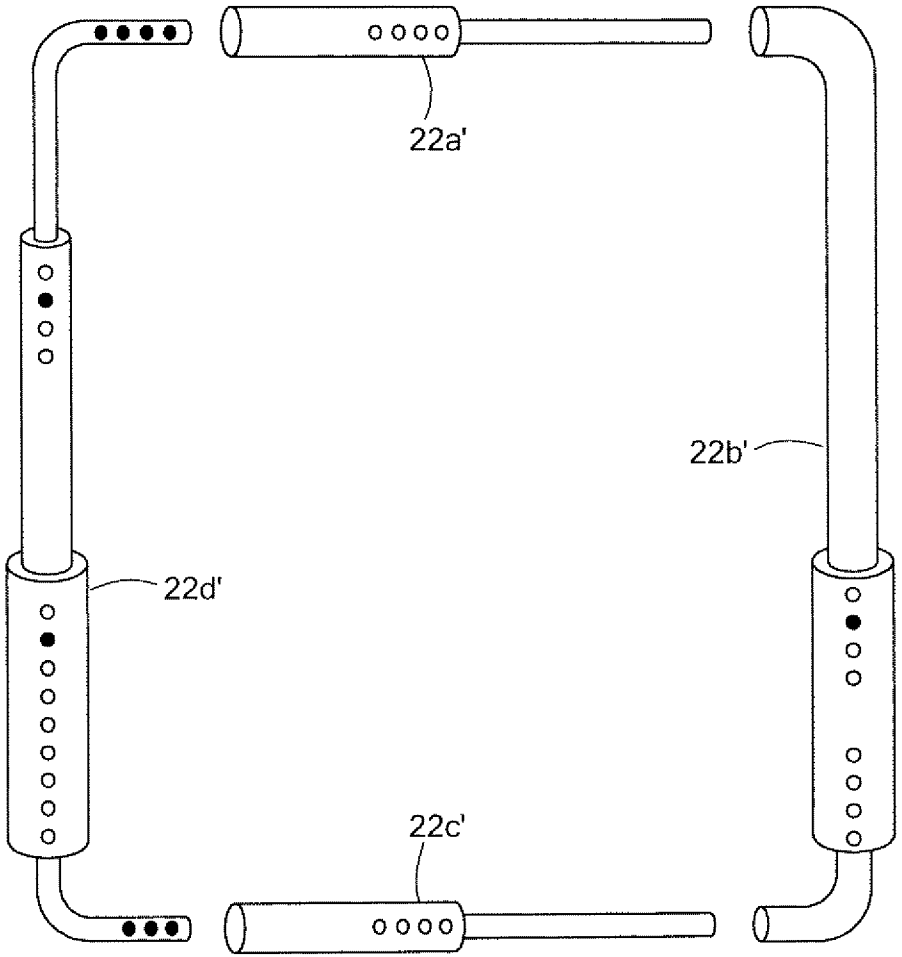
FIG. 11 is a schematic three-dimensional exploded front view showing telescoping frame members in accordance with the subject invention.

FIG. 8 shows shields 80*a*-80*f* and the like in accordance with the subject invention protecting all of the exposed surfaces of vehicle 20. FIG. 9 shows shields 82*a*-82*d* in accordance with the subject invention protecting the driver's side of vehicle 20. Only a few hard points 12''' are shown for clarity. Typically, there is a hard point at each node of the net.

Figure 10:
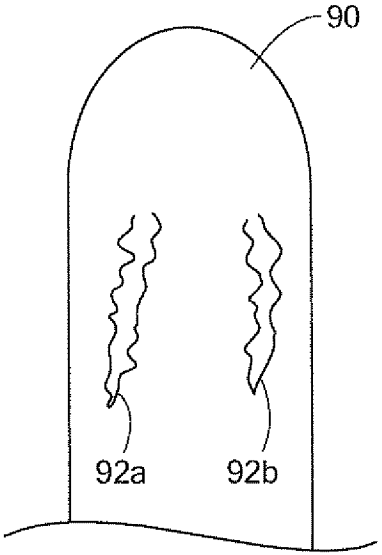
FIG. 10 is a highly schematic three-dimensional top view showing a RPG nose duded by the shield subsystem in accordance with the subject invention.

When an RPG nose or ogive 90, FIG. 10 strikes a shield, the rods or hard points at the nodes of the net(s) angle inwardly toward nose 90 and tear into the skin thereof as shown at 92*a* and 92*b*. The hard points can bridge the inner and outer ogive serving as short to dud the RPG. Or, the hard points tear into the ogive and the torn material acts as a short duding the round. If the net and/or frame is destroyed, another shield is easily installed. The net thus serves to position the hard points in an array at a set off distance from the vehicle or structure to be protected. An effectiveness of 60-70% is possible. Chain link fencing exhibited an effectiveness of about 50%. Netting without hard points likely exhibited an effectiveness of less than 50%. Slat/bar armor reportedly had and effectiveness of around 50%.

FIG. 9 shows how frame members 22*a*' can comprise adjustable length telescoping sections for ease of assembly and for tailoring a particular frame to the vehicle or structured portion to be protected.

In one embodiment, the frame members are made of light weight aluminum. One complete shield with the net attached weighed 1.8 lbs. The shield is thus lightweight and easy to assemble, attach, and remove. If a given shield is damaged, it can be easily replaced in the field. The rods connected to the net cell nodes are configured to angle inwardly when an RPG strikes the net. This action defeats the RPG by duding it since the electronics associated with the explosives of the RPG are shorted as the rods impact or tear through the outer skin of the RPG ogive.

The result, in one preferred embodiment is an inexpensive and light weight shielding system which is easy to install and remove. The shields can be adapted to a variety of platforms and provide an effective way to prevent the occupants of the vehicle or the structure from injury or death resulting from RPGs or other ordinances. When used in connection with vehicles, the shield of the subject invention exhibits a low vehicle signature since it extends only a few inches from the vehicle.

The system of the subject invention is expected to meet or exceed the effectiveness of bar/slat armor and yet the flexible net style shield of the subject invention is much lighter, lower in cost, and easier to install and remove. The system of the subject invention is also expected to meet or exceed the effectiveness of chain link fence style shields and yet the net/hard point design of the subject invention is lower in cost, lighter and easier to install and remove.

Figure 12A:
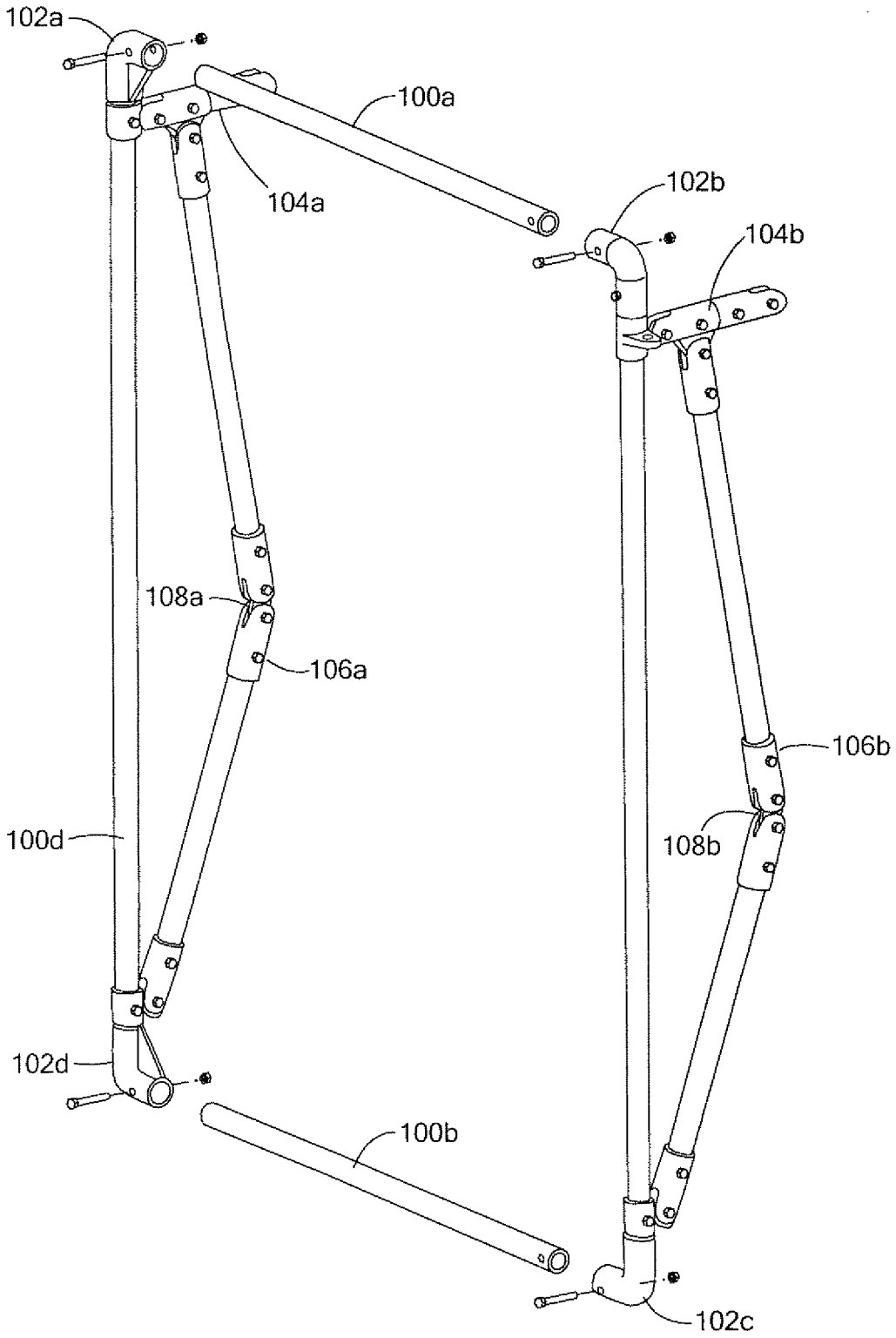
FIG. 12A is a front view of a frame structure in accordance with an example of the invention.
Figure 12B:
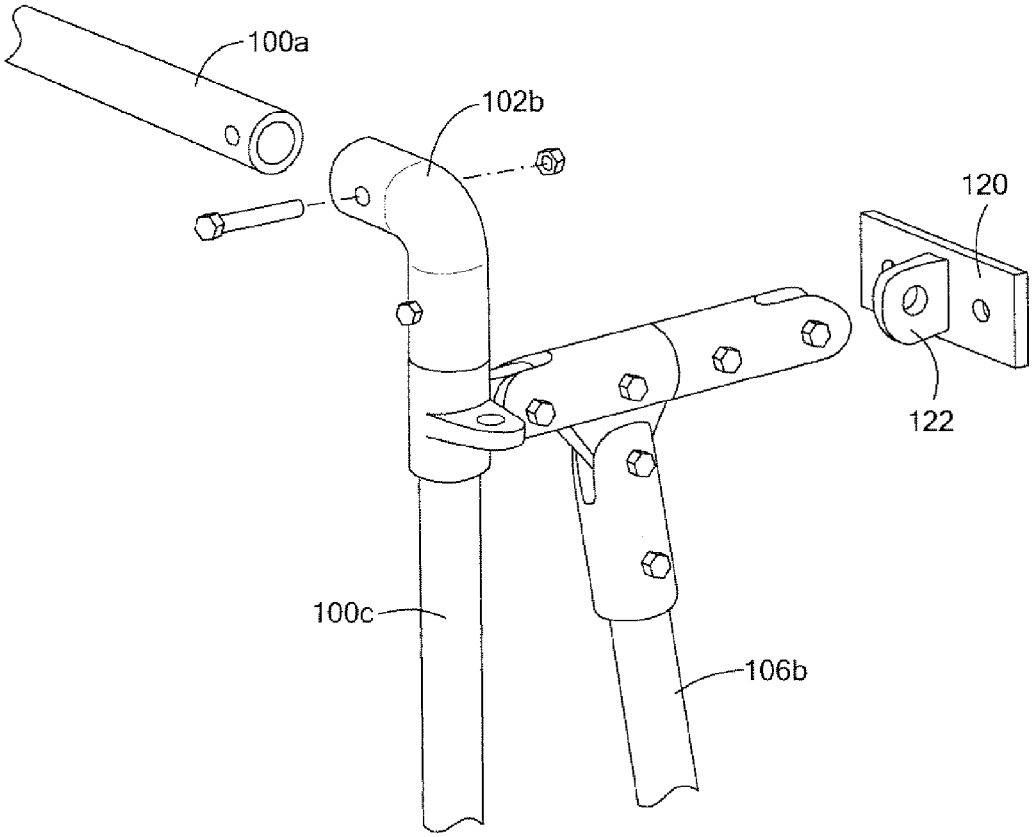
FIG. 12B is a view of one portion of the frame structure shown in FIG. 12A.

One design of a frame 16, FIGS. 12A-12B includes tubular upper frame member 100*a*, lower frame member 100*b*, and side frame members 100*c* and 100*d* all interconnected via corner members 102*a*-*d*. The result is a polygon with spaced sides and an upper and lower portion.

Figure 12C:
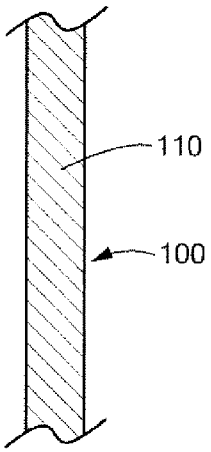
FIG. 12C is a front view of one frame member of the frame structure shown in FIG. 12A showing a spiral wrap of Velcro material thereabout.

Spaced rearwardly extending members 104*a* and 104*b* are attached to the upper portion of the members 100*d* and 100*c*, respectively, just below the corner members 102*a* and 102*b*. Rearwardly extending members 106*a* and 106*b* are on each side of the frame and each include a hinged joint 108*a* and 108*b*, respectively. Each of these members extends between a side member at the bottom of the frame and a rearwardly extending member at the top of the frame where they are hingely attached thereto. All of the hinged joints may be pin and clevis type joints as shown. As shown in FIG. 12C, each frame member 100*a*-100*d* includes a spiral wrap 110 of a hook type fastener material secured thereto to releasably receive the loop type fastener material (32*a*, 32*b*, FIG. 3) of the net fabric border. In this way, the net is easily attached and removed from the frame.

Typically, the frame is attached to the vehicle or structure using metal plates with an ear extending outwardly therefrom, such as plate 120, FIG. 12*b* with ear 122.

In other instances, however, features already associated with the vehicle or structure to be protected can be used to secured the frame with respect to the vehicle or structure.

Figure 13:
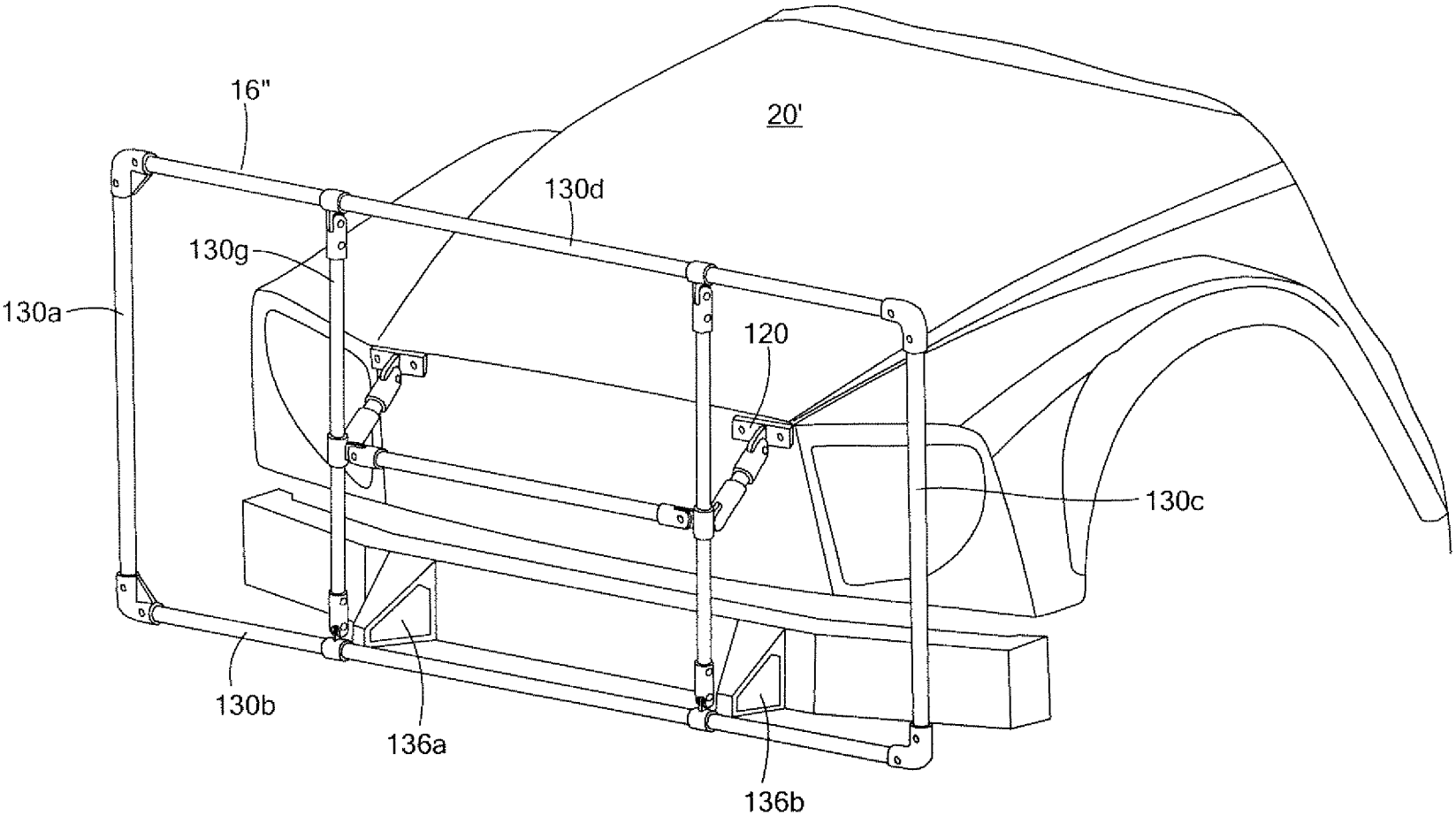
FIG. 13 is a partial schematic view showing a frame structure attached to the front of a vehicle in accordance with an example of the subject invention.

For example, FIG. 13 shows frame 16" attached to a vehicle. Frame 16" includes frame members 130*a*-130*g*, rearwardly extending member 132*a* and 132*b* hingely connected to plates 134*a* and 134*b*, respectively, bolted to the vehicle. Features 136*a* and 136*b* of vehicle 20' are connected to the joints between frame members 130*h*, 130*g* and 130*f*. Thus, the frame, the mounting brackets, and the like may vary in construction depending on the configuration of the vehicle or structure to be protected, the location on the vehicle to protected and the like. Typically, the frame members are tubular aluminum components and in one example they were 1-2 inches outer diameter, 0.75-1.75 inches inner diameter, and between 3 and 10 feet long.

Figure 14:
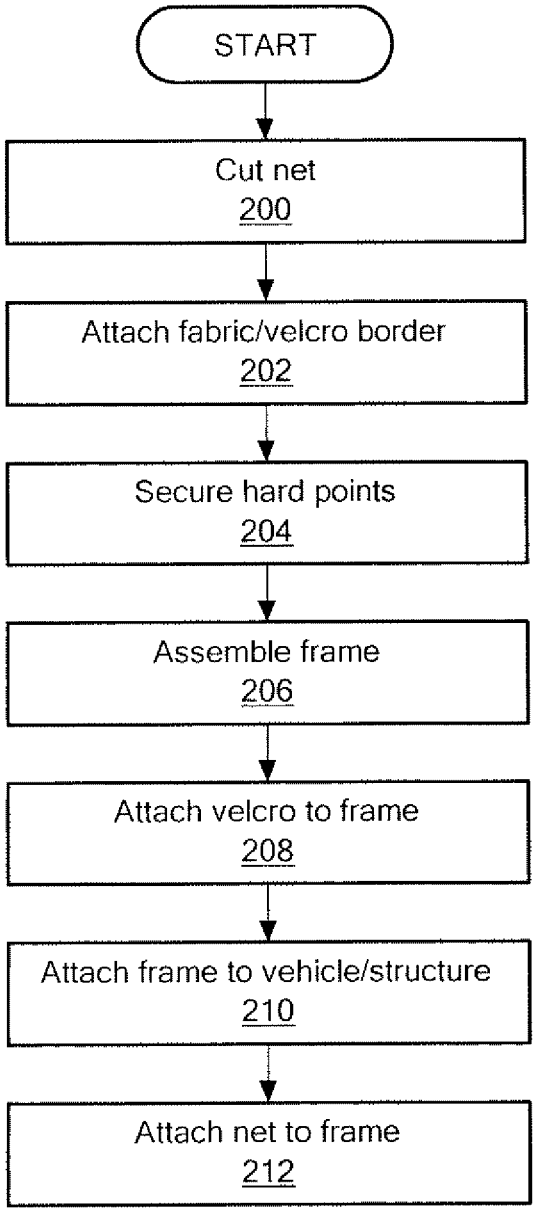
FIG. 14 is a flow chart depicting the primary steps associated with a method of protecting a vehicle or structure in one example of the invention.

Assembly of a vehicle or structure shield, in accordance with the invention, typically begins with cutting the bulk netting, step 200, FIG. 14 into square or rectangular shapes. Next a fabric border is sewed to the net edges, step 202 and includes loop type fastener material on at least one side thereof.

The hard points are they secured to the net nodes, step 204. For example, the net may be laid on a table and hard point female members 72', FIG. 6A-6B are positioned under each node with the net cords extending through slot 73*a*-73*d*. Plugs 68', FIG. 7, are then driven partly into each cavity of the female base portions using finger pressure and/or a hammer. Then, the plugs are seated in their respective cavities using a pneumatic driver.

The appropriate frame is then designed and assembled step 206. FIG. 14, and the hook fastener material is taped or glued to the frame members (see FIG. 12C), step 208. In the field, the frame is secured to the vehicle or structure, step 210, and the net is attached to the frame, step 212, using the loop type fastener material of the net periphery border and the hook fastener material on the frame members.

Assembly of the frame to the vehicle or structure and releasably attaching the net to the frame is thus simple and can be accomplished quickly.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An RPG defeat method comprising:

laterally spacing hard points with respect to each other to dig into an RPG ogive and damage it so the RPG does not detonate, said hard points each weighing between 10 and 80 grams, spacing said hard points outwardly from a hull between 4 centimeters and 60 centimeters, and configuring said hard points to have a length, center of gravity and moment of inertia so the RPG ogive is damaged by rotation of the laterally and outwardly spaced hard points to dig into and dud the RPG ogive before the RPG ogive strikes the hull.

2. The method of claim 1 in which each hard point includes at least six sides and six sharp corners.

3. The method of claim 1 in which laterally spacing the hard points includes securing the hard points to the nodes of a net.

4. The method of claim 3 in which the net has a mesh size of between 110-180 mm and is made of net material having a breaking strength of less than 240 lb.

5. The method of claim 3 in which each hard point includes a base portion with a cavity receiving a net node therein and a post portion received in the cavity of the base portion locking the hard point at a net node.

6. The method of claim 5 in which the base portion cavity frictionally receives a post portion therein.

7. The method of claim 3 in which each hard point includes a wall with longitudinal slots therein for the net.

8. The method of claim 3 in which spacing the hard points sufficiently outwardly from a hull include attaching the net to a frame and connecting the frame to the hull in a spaced relationship therewith.

9. The method of claim 8 in which the frame includes telescoping members.

10. The method of claim 8 furthering including hook and loop type fasteners releasably securing the net to frame.

11. An RPG defeat system comprising:

laterally spaced hard points configured to dig into an RPG ogive and damage it so that the RPG does not detonate, said hard points each weighing between 10 and 80 grams and spaced between 4 centimeters and 60 centimeters outwardly from a hull, and said hard points having a length, center of gravity, and moment of inertia so the RPG ogive is damaged by rotation of the laterally and outwardly spaced hard points to dig into and dud the RPG ogive before the RPG ogive strikes the hull.

12. The system of claim 11 in which each hard point includes at least six sides and six sharp corners.

13. The system of claim 12 in which the net has a mesh size of between 110-180 mm and is made of net material having a breaking strength of less than 240 lb.

14. The system of claim 11 in which the hard points are secured to nodes of a net.

15. The system of claim 14 in which each hard point includes a base portion with a cavity receiving a net node therein and a post portion received in the cavity of the base portion locking the hard point at a net node.

16. The system of claim 15 in which the base portion cavity frictionally receives a post portion therein.

17. The system of claim 14 in which each hard point includes a wall with longitudinal slots therein for the net.

18. The system of claim 14 in which the net is attached to a frame and the frame is attached to the hull in a spaced relationship therewith.

19. The system of claim 18 in which the frame includes telescoping members.

20. The system of claim 18 further including hook and loop type fasteners releasably securing the net to frame.

* * * * *